US010833399B1

(12) United States Patent
Howarth et al.

(10) Patent No.: US 10,833,399 B1
(45) Date of Patent: Nov. 10, 2020

(54) EMBEDDED WIDE BAND MONOCONE ANTENNA

(71) Applicant: BAE SYSTEMS INFORMATION AND ELECTRONIC SYSTEMS INTEGRATION INC., Nashua, NH (US)

(72) Inventors: Dean W. Howarth, Sudbury, MA (US); Jonothan S. Jensen, Nashua, NH (US); Andrew C. Maccabe, Milford, NH (US); Patrick D. McKivergan, Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 42 days.

(21) Appl. No.: 16/117,013

(22) Filed: Aug. 30, 2018

(51) Int. Cl.
*H01Q 1/28* (2006.01)

(52) U.S. Cl.
CPC ..... *H01Q 1/28* (2013.01)

(58) Field of Classification Search
CPC ..... H01Q 1/28; H01Q 13/00; H01Q 13/04; H01Q 13/06; H01Q 1/36; H01Q 1/38; H01Q 9/28
USPC ..... 343/705
See application file for complete search history.

(56) References Cited

U.S. PATENT DOCUMENTS

| | | | | |
|---|---|---|---|---|
| 9,077,080 | B1 * | 7/2015 | Josypenko | H01Q 13/04 |
| 2005/0156804 | A1 * | 7/2005 | Ratni | H01Q 9/28 343/773 |
| 2009/0289865 | A1 * | 11/2009 | Parsche | H01Q 9/28 343/772 |
| 2012/0044119 | A1 * | 2/2012 | Libonati | H01Q 9/28 343/807 |
| 2012/0068903 | A1 * | 3/2012 | Thevenard | H01Q 3/247 343/795 |
| 2015/0280317 | A1 * | 10/2015 | Morin | H01Q 9/28 343/795 |
| 2016/0043472 | A1 * | 2/2016 | Fasenfest | H01Q 13/02 343/786 |
| 2020/0014423 | A1 * | 1/2020 | Britz | H04B 1/04 |
| 2020/0075833 | A1 * | 3/2020 | Topaloglu | H01L 39/2493 |

* cited by examiner

*Primary Examiner* — Huedung X Mancuso
(74) *Attorney, Agent, or Firm* — Sand, Sebolt & Wernow LPA; Scott J. Asmus

(57) ABSTRACT

A cone antenna has at least one resistor electrically coupled to the radiating structure of the cone antenna. The capacitor may be part of a resistor network that is electrically connected to the cone. One or more patches may be coupled to the resistor network which act as a capacitor. A feed card may be embedded within a ground plane to enable the exterior of an antenna assembly to be conformal with an outer surface of a platform carrying the cone antenna.

14 Claims, 15 Drawing Sheets

EMBEDDED WIDE BAND MONOCONE ANTENNA

BACKGROUND

Technical Field

The present disclosure relates generally to cone antennas. More particularly, the present disclosure relates to an embedded cone antenna. Specifically, the present disclosure relates to a cone antenna coupled to at least one resistor to increase the bandwidth that the cone antenna receives.

Background Information

Monocone antennas have a cone-shaped radiating element that is electrically charged. Monocone antennas are used as transmit/receive antennas for wideband applications. Monocone antennas are typically very small and have positive gain. They have a simple construction that provides about a hemisphere worth of field of view. Typically, monocone antennas are sized at most up to half a wavelength at the highest bandwidth frequency operable for that antenna.

Monocone antennas may be mounted on moveable platform or a stationary object. When mounted on a moveable platform, the monocone may extending outwardly from a portion of outer surface of the platform and into the airstream.

SUMMARY

Issues continue to exist with the need for improving antenna technology. Particularly, the need continues to exist for an antenna to operate in a broader bandwidth range without increasing size, weight, or power of the antenna itself. Furthermore, a need continues to exist for a monocone antenna that is mounted on a platform and does not extend into the airstream so as to provide a more aerodynamic design. The present disclosure addresses these and other issues by providing an improved monocone antenna.

In accordance with one aspect of the present disclosure, a monocone antenna assembly may provide an omnidirectional conformal small form factor receiving Monocone antenna with at least a decade of usable bandwidth. The antenna of the present disclosure enables VSWR achievement of less than 3:1 from about 4 GHz to about 40 GHz with gradual low end roll-off while maintaining a gain requirement of at least −5 dBi at 10 degrees of elevation. The geometry of portions of the monocone antenna assembly provides an inverted truncated monocone (cone) that is recessed into an inverted truncated conical cavity with a fixed diameter base and height that are optimized for 50 Ohm input match in the presence of an infinite ground plane using parametric analysis. The monocone antenna assembly includes a top card having a circuit board contained thereon. The top card extends the lowest operating frequency while the feed card sets the height of the monocone above the ground plane (to within the circuit card manufacturer's tolerance) which determines the input impedance. In accordance with this aspect of the present disclosure, the cone acts as the center conductor for a male GPO connector and is inserted into a circuit card which sets the cone height above the ground plane. The tolerance is therefore set by the board thickness tolerance and eliminates the need for post-assembly tuning.

The top card may be considered a top-hat circuit card that is used to extend the lowest operating frequency from about 8 GHz to about 4 GHz. The top card presents as a series capacitance at lower frequencies and is transparent to frequencies greater than about 16 GHz. The series capacitance acts to cancel out the reactance associated with the small electrical length of the cone less than about 8 GHz. The top card is configured to control the current distribution to capacitive patches and can meet manufacturing constraints, such as minimum trace widths and resistor pad sizes. The proper functioning of the top card is dependent on the ordering of the layers due to the relative sizes of the patches, resistors, and traces as well as the need for a gap between the top of the cone and the patch layer as defined by the dielectric spacer or substrate, all of which effect the amount and uniformity of the capacitance generated by the top card. This configuration should solve a significant amount of azimuthal ripple that may present itself with top cards having different physical configurations, such as a square configuration.

In accordance with another aspect of the present disclosure, the monocone antenna assembly may include a monocone, a feed card, a top card assembly, which may include the dielectric spacer or substrate, a feed card adaptor plate, a ground plane, and a GPO connector. The feed card adaptor plate and the ground plane may be machined from aluminum. The feed card and the top-hat card assembly may be printed on 0.02 inch and 0.01 inch Rogers RO4730JXR and RO4730G3 circuit boards, respectively, and resistors may be soldered onto the top card. The monocone may be formed from copper. In accordance with one aspect, bare copper may be finished according to IAW IPC-6012, EN IG. In assembling the parts of the monocone antenna assembly, the GPO connector is soldered to the feed card and bonding the feed card to the feed card adaptor plate. While the bond cures, the resistors are soldered to the resistor layer of the top card and the top card is then soldered to a feed pin protruding upwardly from the monocone. After the bond is cured, the feed card adaptor assembly is aligned to the ground plane using built-in alignment pins and may be attached at six points with screws. When the feed card adaptor assembly is firmly in place, the top card assembly is pressed into the feed card. When inserting a cable into the GPO connector, the force of the connection could push against the monocone. Without any counteracting force, the monocone may be pushed out of the feed card. Thus, a radome cover may be positioned over the monocone so as to provide structural support that sits flush or closely adjacent with the top card to provide a stable support surface to the monocone during cable connection with the connector.

In accordance with one aspect of the present disclosure, the monocone antenna assembly provides an exemplary embodiment that is used to extend the lowest operating frequency of the geometrically optimized monocone antenna from 8 GHz down to 4 GHz. Furthermore, the integration of a conformal recessed monocone antenna and the top card with an operational bandwidth of 10:1 in positive gain in a small form factor package has been successfully demonstrated by the assembly of the present disclosure.

In accordance with another aspect of the present disclosure, an exemplary embodiment of the present disclosure may provide a cone antenna assembly comprising: a cone including a frustoconical sidewall extending from a first end to a second end, the first end having a diameter greater than the second end; and a first pin in electrical communication with the frustoconical sidewall extending outwardly from the first end. This exemplary embodiment or another exemplary embodiment may further provide at least one resistor in electrical communication with the first pin. This exemplary embodiment or another exemplary embodiment may further provide a plurality of resistors arranged in a network and in electrical communication with the first pin. This exemplary embodiment or another exemplary embodiment may further provide a first row of at least two resistors in series along a conductive element. This exemplary embodiment or another exemplary embodiment may further provide a second row of at least two resistors in series along the conductive element that are electrically parallel to the first row. This exemplary embodiment or another exemplary embodiment may further provide a central aperture formed in the conductive element that receives the first pin therethrough; and an electrical connection between the first pin and the conductive element. This exemplary embodiment or another exemplary embodiment may further provide a patch layer in electrical communication with the plurality of resistors that effectuates performance as a lossy capacitor. This exemplary embodiment or another exemplary embodiment may further provide a plurality of independent patches in the patch layer, wherein at least one patch from the plurality of independent patches is electrically connected with the plurality of resistors. This exemplary embodiment or another exemplary embodiment may further provide a layer of material surrounding the first pin disposed between the patch layer and the first end of the frustoconical sidewall of the cone. This exemplary embodiment or another exemplary embodiment may further provide a feed card in electrical communication with the cone adjacent the second end; a ground plane including a first surface opposite a second surface; a recess formed in the second surface shaped complementary to the feed card, and the feed card is disposed with the recess; wherein the cone extends outward from the first surface on the ground plane. This exemplary embodiment or another exemplary embodiment may further provide a connector connected with the feed card, wherein a portion of the connector is coplanar with the ground plane. This exemplary embodiment or another exemplary embodiment may further provide a second pin in electrical communication with the frustoconical sidewall extending outwardly from the second end; and a central bore defined by a portion of the connector, and the second pin positioned within the central bore. This exemplary embodiment or another exemplary embodiment may further provide a ground spacer on the feed card that eliminates manual manipulation to separate the cone from the ground plane. This exemplary embodiment or another exemplary embodiment may further provide a cover over the cone to counteract a physical force applied to the connector by a feed when the feed is attached to the connector.

In accordance with another aspect of the present disclosure, an exemplary embodiment of the present disclosure may provide a cone antenna assembly comprising: a cone including a frustoconical sidewall extending from a first end to a second end, the first end having a diameter greater than the second end; and at least one resistor in electrical communication the frustoconical sidewall. This exemplary embodiment or another exemplary embodiment may further provide a plurality of resistors arranged in a network and in electrical communication with the frustoconical sidewall; a first row of at least two resistors in series along a conductive element; a second row of at least two resistors in series along the conductive element that are electrically parallel to the first row; a third row of at least two resistors in series along the conductive element that are electrically parallel to the first row; a fourth row of at least two resistors in series along the conductive element; a fifth row of at least two resistors in series along the conductive element that are electrically parallel to the fourth row; and a sixth row of at least two resistors in series along the conductive element that are electrically parallel to the fourth row.

In accordance with another aspect of the present disclosure, an exemplary embodiment of the present disclosure may provide a method for a cone antenna comprising: feeding current through a connector coupled to a feed card disposed within a recess formed in a ground plane; feeding current along a frustoconical sidewall from a second end to a first end thereof; feeding current from the frustoconical sidewall across a resistor network; and receiving signals over at least one decade of frequency bandwidth. This exemplary method or another exemplary method may further provide feeding current along a first pin from the frustoconical sidewall to the resistor network that is electrically coupled to the first pin. This exemplary method or another exemplary method may further provide feeding current through at least two resistors in series along the resistor network that are coupled with a plurality of patches that are coupled to the resistor network that effective function as lossy capacitors.

A cone antenna has at least one resistor electrically coupled to the radiating structure of the cone antenna. The capacitor may be part of a resistor network that is electrically connected to the cone. One or more patches may be coupled to the resistor network which act as a capacitor. A feed card may be embedded within a ground plane to enable the exterior of an antenna assembly to be conformal with an outer surface of a platform carrying the cone antenna.

BRIEF DESCRIPTION OF THE SEVERAL VIEWS OF THE DRAWINGS

Sample embodiments of the present disclosure are set forth in the following description, is shown in the drawings and is particularly and distinctly pointed out and set forth in the appended claims.

Similar numbers refer to similar parts throughout the drawings.

DETAILED DESCRIPTION

Figure 1:
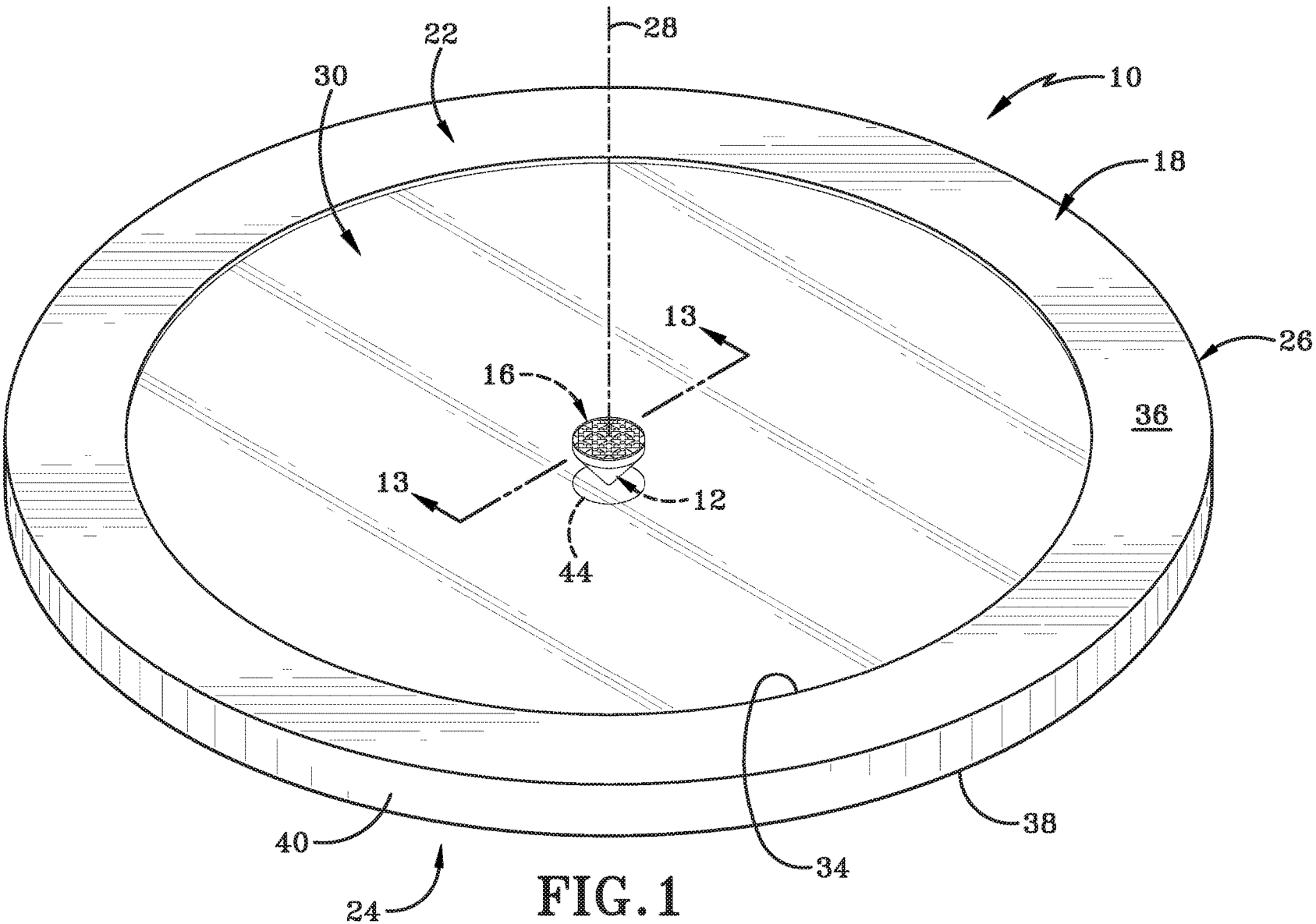
FIG. 1 is a top perspective view of a monocone antenna assembly in accordance with the present disclosure.

FIG. 1 depicts an assembled monocone antenna assembly generally at 10.

Figure 2:
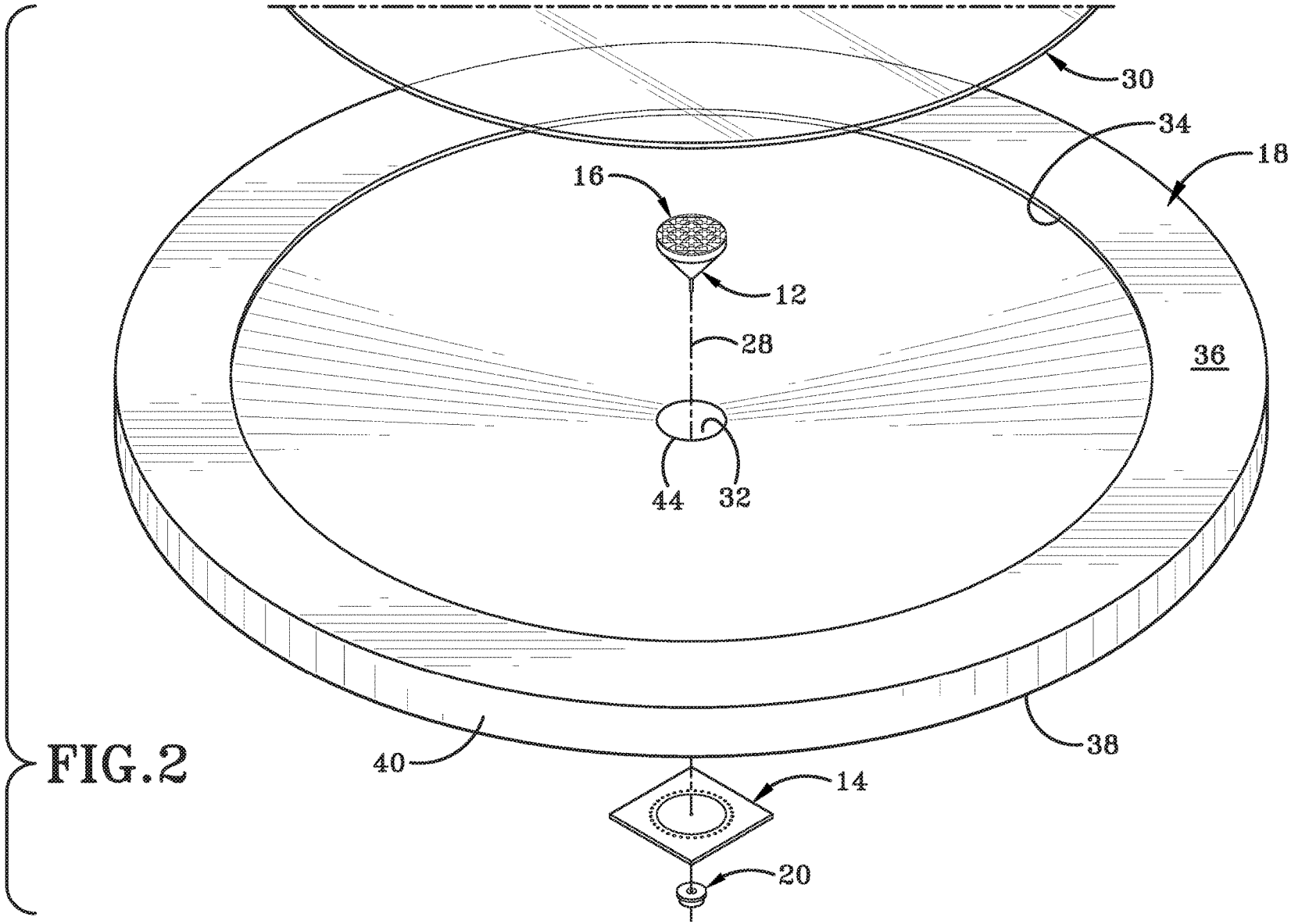
FIG. 2 is an exploded perspective view of the monocone antenna assembly.

The monocone antenna assembly 10 may include a monocone 12, a feed card 14 (FIG. 2), a top loading card 16, a ground plane 18, and a connector 20 (FIG. 2).

With continued reference to FIG. 1, the monocone antenna assembly 10 generally includes a first or top side 22 opposite a lower or second side 24 defining a vertical direction therebetween. Assembly 10 may include a generally circular outer perimeter 26 extending circumferentially around a central vertical axis 28. Portions of the monocone antenna assembly 10 will be described herein relative to the central vertical axis 28, and relative terms, such as radially inward or radially outward, may be applicable to describe some components of the assembly 10, however, are not intended to be limiting. For example, the outer perimeter 26 is positioned radially outward at a greater distance from the central vertical axis 28 than the monocone 12, the feed card 14, the top loading card 16, the ground plane 18, and the connector 20. In one particular embodiment, portions of the monocone 12, the feed card 14, the top loading card 16, the ground plane 18, and the connector 20 are aligned coaxial with the central vertical axis 28.

FIG. 2 depicts the exploded components of the monocone antenna assembly 10 depicting that a top radome cover 30 is positioned above the top loading card 16. The top loading card 16 rests atop the monocone 12 which is aligned centrally along the vertical axis 28 and extends through a central aperture 32 formed in the ground plane 18 via edge 44. The feed card 14 is positioned below the monocone 12. In one particular embodiment, feed card 14 is positioned below a bottom surface of the ground plane 18. The connector 20 is positioned below the bottom surface of the feed card 14. Feed card 14 and connector 20 are aligned centrally along vertical axis 28 and will be described in greater detail below. Radome cover 30 may be a generally circular member having a thickness less than the thickness of the ground plane 18 and upwardly facing top surface that aligns generally coplanar with the upwardly facing top surface of the ground plane 18. In one particular embodiment, radome cover 30 has a diameter less than that of the ground plane 18 such that the radome cover 30 fits within a circular edge 34.

Figure 3:
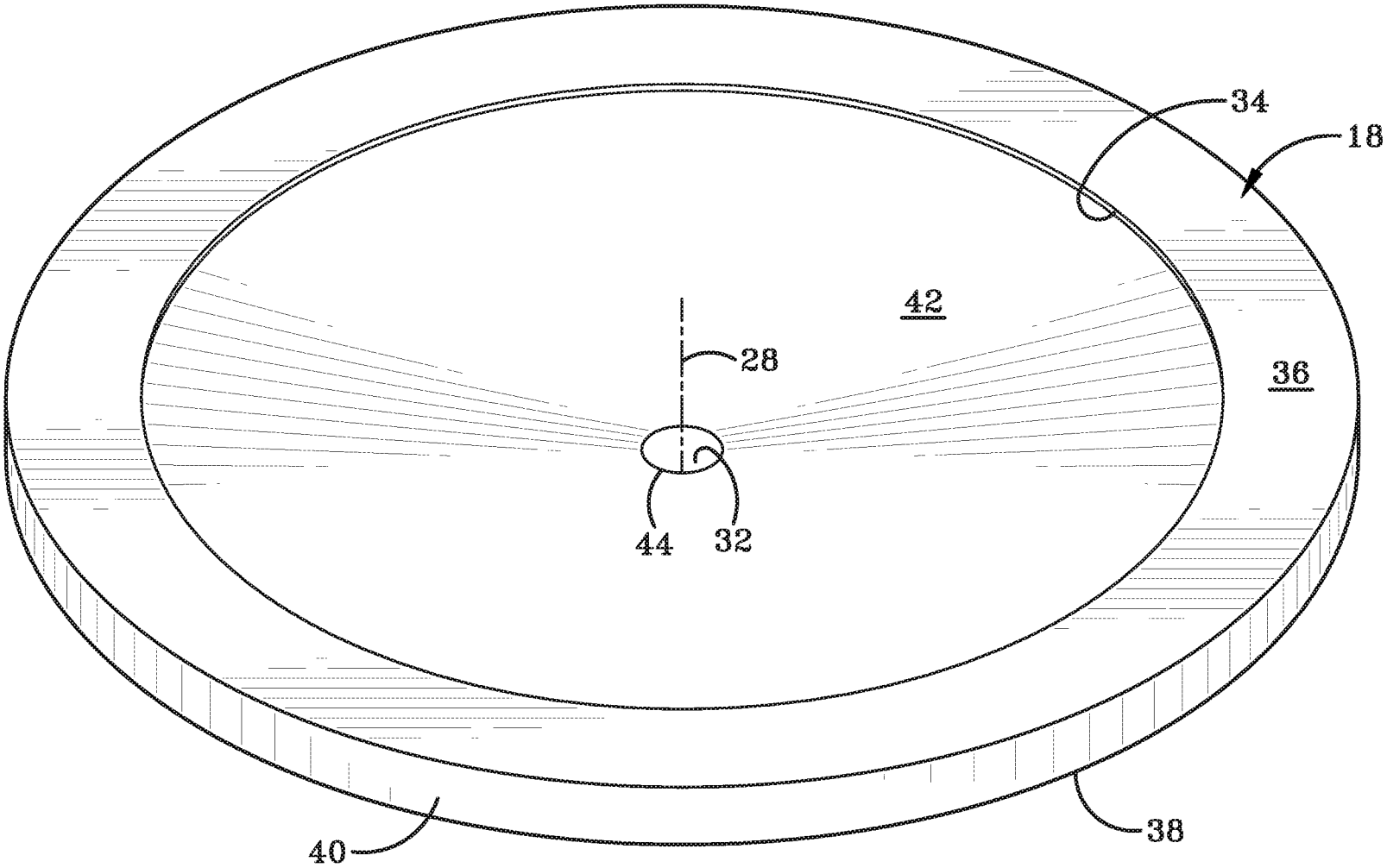
FIG. 3 is a top perspective view of a ground plane of the monocone antenna assembly.
Figure 4:
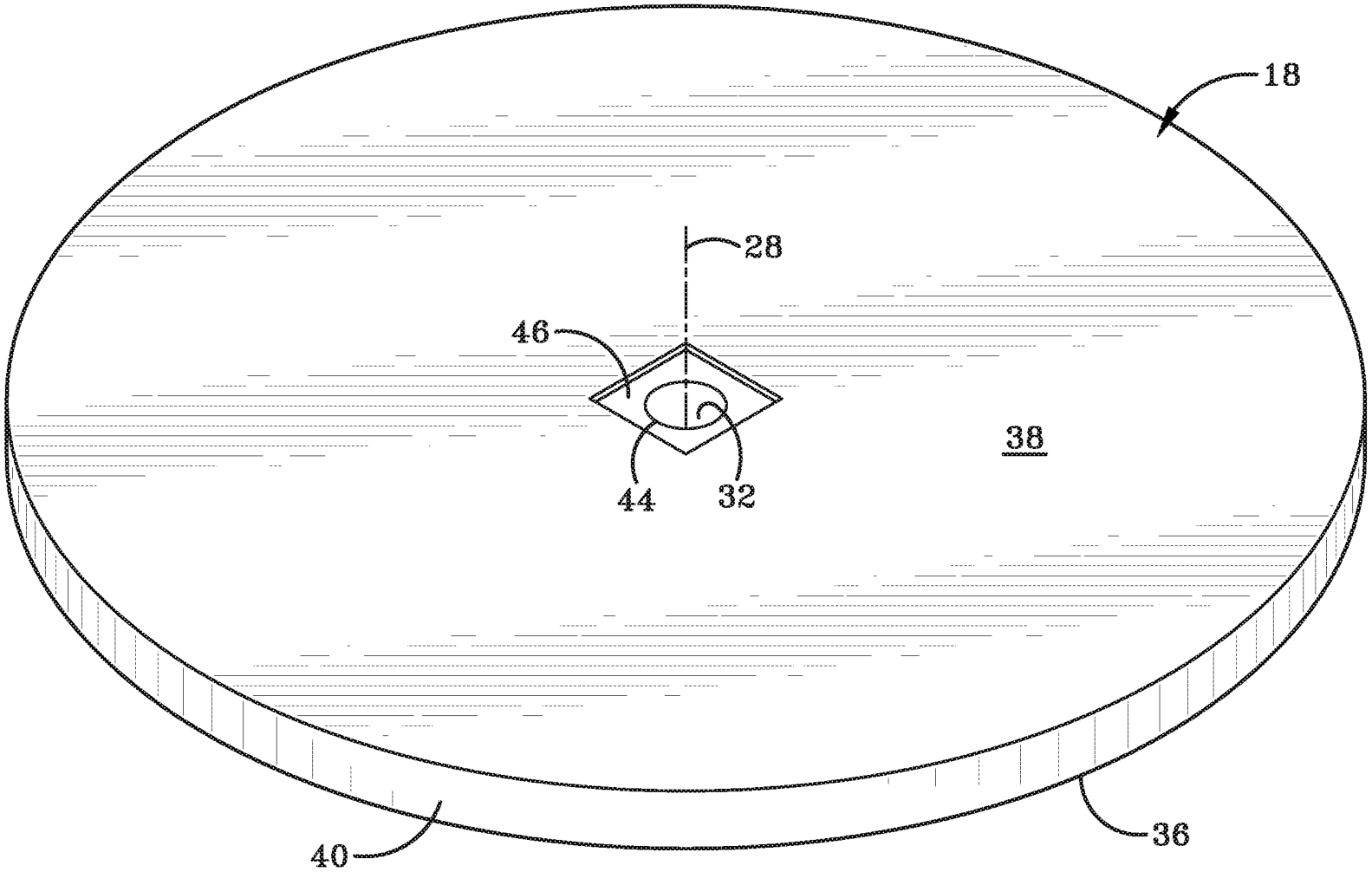
FIG. 4 is a bottom perspective view of the ground plane.

FIG. 3 and FIG. 4 depict the ground plane 18 as having a upwardly facing top surface 36 opposite a downwardly facing bottom surface 38. A cylindrical sidewall 40 is defined by a vertical thickness of the ground plane 18 measured between the first surface 36 and second surface 38. The outer perimeter 26 is defined by the ground plane 18. The outer perimeter 26 may have a first radius relative to the central vertical axis 28. The circular edge 34 may have a second radius relative to the central vertical axis 28. The second radius is less than the first radius. The interior portion 42 of the first surface 36 is conically shaped. The inner portion 42 of the first surface 36 tapers downwardly from edge 34 in a conical manner to an inner annular edge 44 which defines opening 32. Opening 32 may have a diameter of about 0.15 inch. The vertical thickness of the ground plane 18 establishing the cylindrical sidewall 40 is substantially uniform between the outer perimeter 26 and the circular edge 34 and may be about 0.25 inch thick. However, the thickness of the ground plane 18 tapers and reduces in value between the circular edge 34 to the inner annular edge 44. The radius of the circular edge 34 is slightly larger than or complementary to the radius of the radome cover 30 which enables the radome cover to be centered about the vertical axis 28 and nest within a ledge or seat defined by circular edge 34. In one particular embodiment, the diameter of the circular edge 34 extending across the central vertical axis 28 is about four inches. Thus, the diameter of the radome 30 would similarly be about four inches which will enable the radome cover 30 to nest within and above the tapered portion 42 of the first surface 36.

FIG. 4 depicts a view of the second surface 38 of the ground plane 18. Second surface 38 includes a square-shaped cutout 46 defined by an edge 48. In one particular embodiment, edge 48 is square-shaped and centered about the central vertical axis 28. The cutout 46 extends upwardly into the ground plane 18 to form a depression that is in open communication with opening 32. Inner annular edge 44 is centered within the cutout 46. As will be described in greater detail below, ground plane 14 is sized to fit within the cutout 46. Stated otherwise, the dimensions of the edge 48 complement that of the ground plane 14 to allow the ground plane 14 to nest within the cutout 46. When the ground plane 14 nests within the cutout 46, the bottom or second surface 38 is substantially coplanar with the bottom of the ground plane 14.

Figure 5:
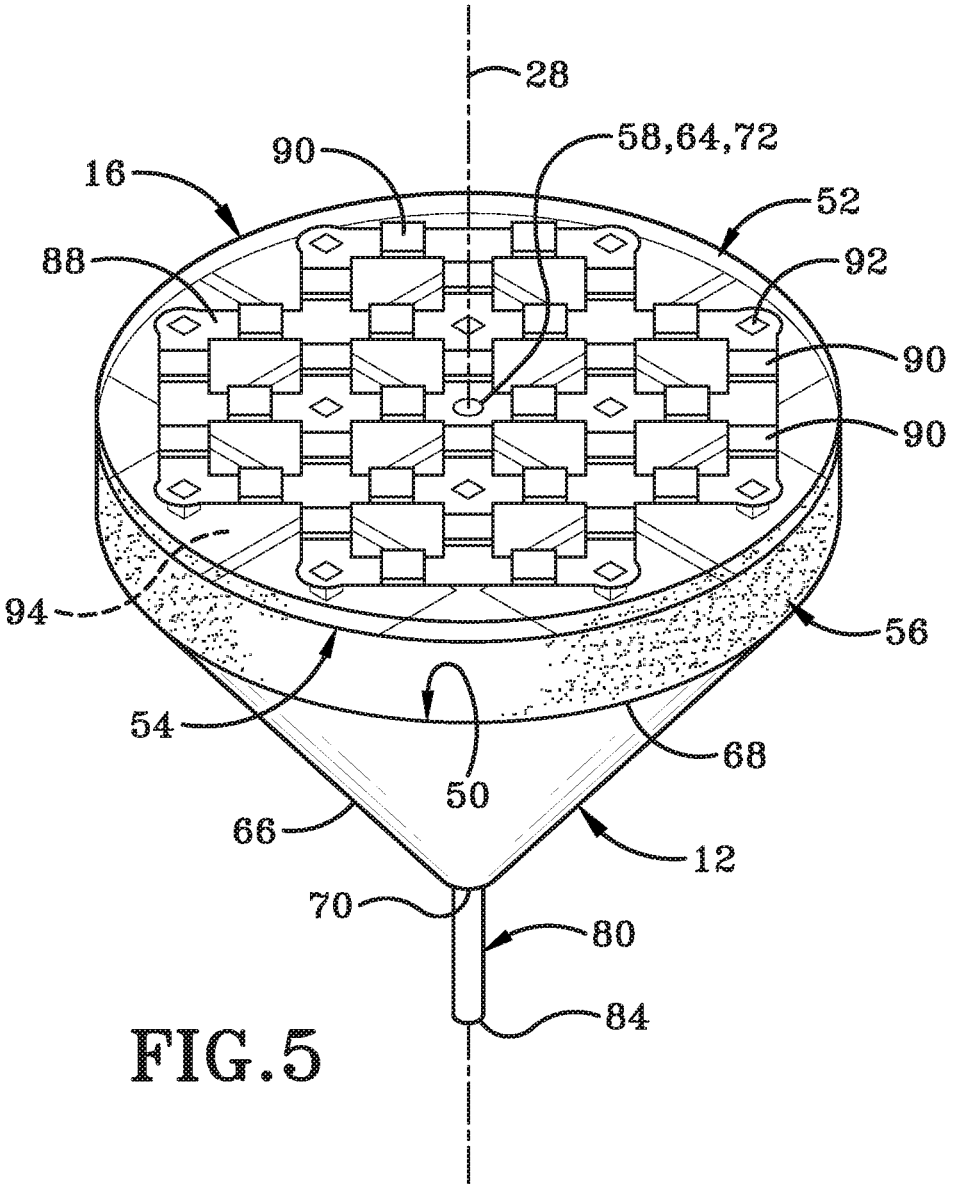
FIG. 5 is a top perspective view of a cone having a loading card supported thereby and the loading card having a resistor network coupled with the cone.

FIG. 5 depicts an enlarged prospective view of the monocone 12 having the top loading card 16 supported thereby. Particularly, top loading card 16 is positioned above a first upwardly facing surface 50 (FIG. 6) of the monocone 12.

Figure 6:
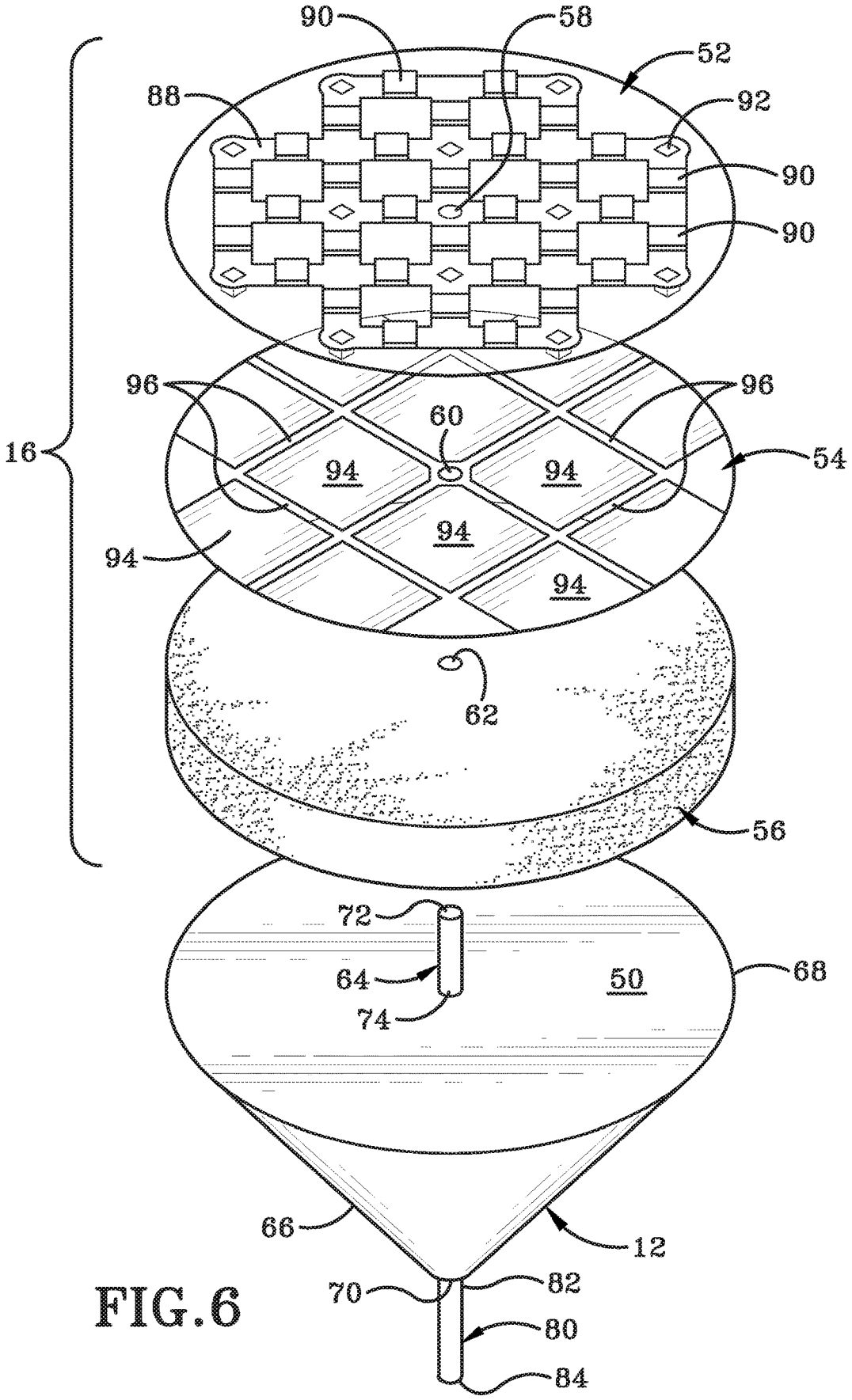
FIG. 6 is an exploded top perspective view of the cone and the loading card.

As depicted in FIG. 5 and FIG. 6, the top loading card 16 may include, generally, three layers. A first layer 52 may be a resistor layer. A second layer 54 may be a patch layer. A third layer 56 may be a spacing layer. The first layer 52 is positioned above the second layer 54 which is positioned above the third layer 56. Third layer 56 is positioned above top surface 50 on monocone 12. The first layer 52 and the second layer 54 will be described in greater detail below. The third layer 56 may be formed from Rogers material, such as Rogers RT/Duroid 5880LZ and is configured to act as a spacer to position the first layer 52 at an optimal height above surface 50 on monocone 12. In one particular embodiment, the vertical thickness of the third layer 56 formed from Rogers material is about 40 mil. Furthermore, the radius of the third layer 56 may be generally equal to the maximum radius of the monocone 12 at the top surface 50, which may be about 0.3 inch.

First layer 52 may form a central opening 58 that aligns with a central opening 60 defined in the second layer 54 and aligns with the central opening 62 formed in the third layer 56. The apertures 58, 60 and 62 align in a vertical manner and are positioned to receive a top pin 64 (FIG. 7) on the monocone 12 therethrough. A portion of the first layer 52 is electrically connected with the top pin 64. In one particular embodiment, the third layer 56 is not electrically connected with the top pin 64, but rather is merely supported thereby.

Figure 7:
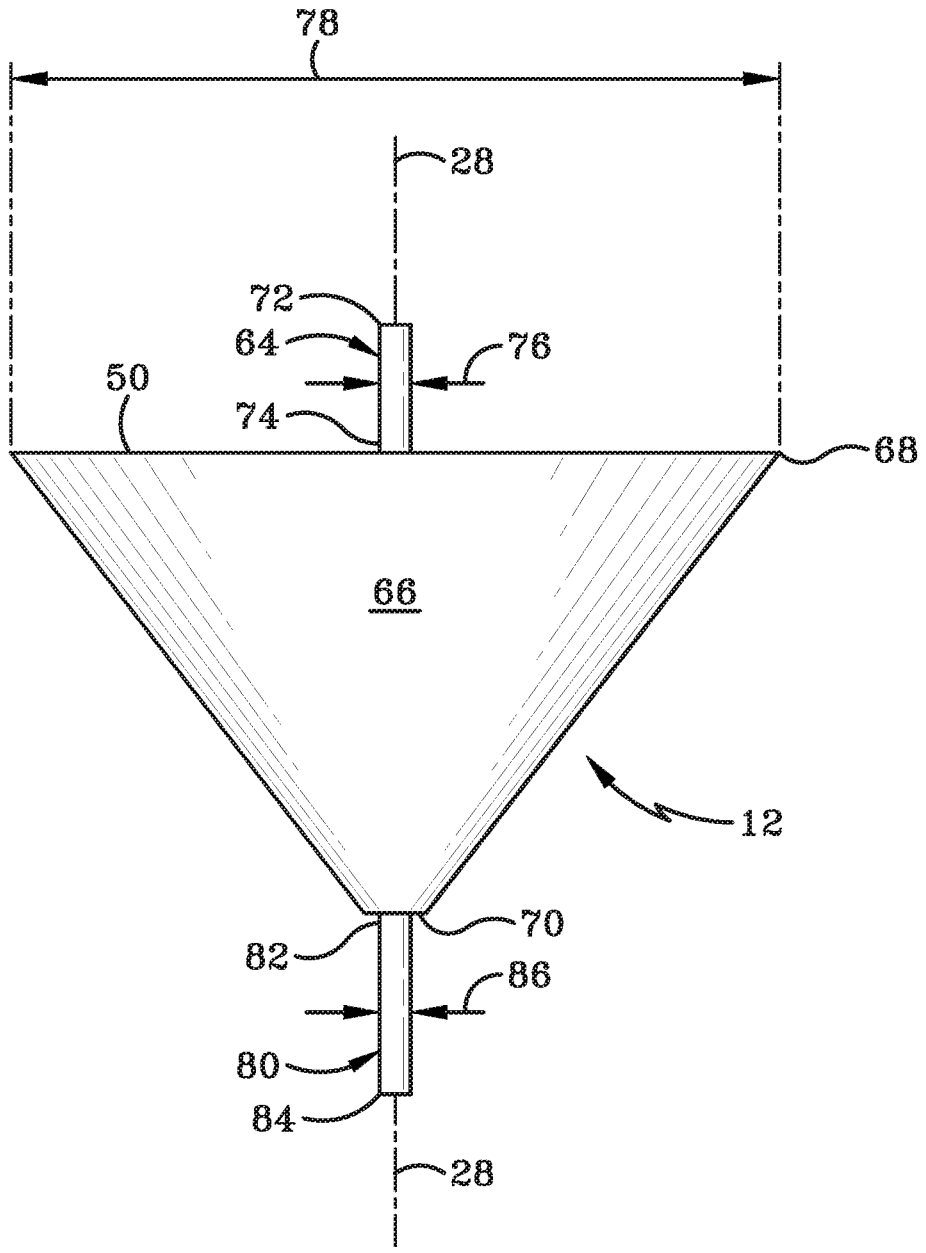
FIG. 7 is a side elevation view of the cone.

FIG. 7 depicts that monocone 12 includes a conical or frustoconical sidewall 66 that tapers downwardly and inwardly towards the vertical axis 28 from the top edge 68 to a bottom edge 70. Sidewall 6 may form a portion of a radiating element of monocone 12. Top edge 68 is defined by the perimeter of the monocone 12. Stated otherwise, the top edge 68 is associated with the base of the monocone 12; however, the base refers to the maximum dimension of the monocone which is aligned vertically upward. The upwardly facing first surface 50 of the monocone 12 is bound by the top edge 68 and extends to enclose the monocone 12 such that the monocone 12 is substantially solid. Alternatively, monocone 12 may be hollow so long as the conical sidewall 66 is connected with a top surface 50. Top surface 50 is in electrical communication with pin 64 which extends upwardly in a cantilevered manner to a terminal free end 72. The base 74 of the top pin 64 is electrically connected with top surface 50 and is centered along the vertical axis 28. While the top pin 64 is shown as centrally aligned along the central vertical axis 28, it is possible for the pin 64 to be positioned in other locations along the top surface 50 without departing from the scope of the present disclosure. Furthermore, while a single pin 64 is depicted, it is further possible to have a plurality of pins that extend upwardly from first surface 50 on monocone 12 without departing from the scope of the present disclosure. In the event that a plurality of top pins are provided on the first surface 50, corresponding holes or apertures would need to be formed in the first layer 52, the second layer 54, and the third layer 56 in order to effectuate the electrical connection of the plurality of top pins 64 with the resistors in the first layer 52.

Top pin 64 may have a diameter 76 that is in a range from about 0.0001 inches to about 0.1 inch. In one particular embodiment, the diameter 76 of the top pin 64 is about 0.12 inch. The diameter of the monocone 12 at the upper edge 68 measured through the central vertical axis 28 is about 0.3 inch. Thus, the diameter 78 of the monocone 12 relative to the diameter 76 of the top pin 64 may be a ratio in a range from about 3:1 to about 300:1. However, in one particular embodiment, the ratio of the diameter 78 to the diameter 76 is about 30:1 (0.3:0.012).

Top pin 64 may further be referred to herein as first pin 64. The first pin 64 is an electrical communication with the frustoconical sidewall 66 and extends outwardly from the first end, which is congruent or the same as top edge 68. In one particular embodiment, first pin 68 does not necessarily need to be a cylindrically elongated member extending along the central axis 28. For example, the first pin may be one or more electrical via(s) that effectuates an electrical connection between at least one resister and the sidewall 66. Thus, while the first pin 64 extends outwardly from the first upwardly facing top surface 50 of the cone 12, other implementations of the pin may be provided in which the pin does not extend outwardly from the first end of the cone. For example, it may be possible for an electrical communication to be established between a via connected with the top surface 50 of the cone 12 as to effectuate an electrical connection with the cylindrical sidewall 66. However, as can be seen throughout the figures, when the first pin 64 is embodied as a cylindrical member formed from a conductive material extending outwardly from the first end or top edge 68 of the sidewall 66, the first pin 64 may provide an advantage of being able to center and balance the top card 16 above the sidewall 66 and atop the top surface 50.

The monocone 12 further includes a second pin 80 extending downwardly and outwardly from the bottom edge 70 in a generally cantilevered manner relative to and along the longitudinal axis 28. Pin 80 includes a base 82 that is rigidly secured with the bottom edge 70 of the monocone 12. Pin 80 extends linearly along the length of the bottom pin 80 to a terminal free end 84. In one particular embodiment, the diameter 86 of the second pin 80 is equal to that of diameter 76 of the top pin 64. Thus, since the diameter 86 of the bottom pin 80 may be equal to that of diameter 76 of the top pin 64, the ratios of the bottom pin 80 relative to diameter 78 of monocone 12 may be in similar ranges from about 3:1 to about 300:1. Furthermore, in one particular implementation, the diameter of the base of the monocone 12 at the bottom edge 70 is about 0.24 inches. Thus, the ratio of the diameter of the monocone 12 at the bottom edge 70 relative to the diameter of the pin 80 is about 2:1 (0.024:0.12).

In one particular embodiment, the monocone 12 may be entirely fabricated from a conductive material, such as metal. However, there are other conductive materials that may be utilized to fabricate monocone 12. It is possible for a monocone 12 to be manufactured from separate pieces of material, such as a cone member and two wires being soldered thereto to form the top pin 64 and the bottom pin 80, respectively. However, it is entirely possible for the monocone 12 to be entirely 3-D printed as a single unibody monolithic member. For example, 3-D printer technology makes it possible to have conductive materials formed from as a single unit. Furthermore, 3-D printing the monocone 12 enables the monocone 12 to be either (i) hollow and capped with the top surface 50 or be (ii) entirely solid.

Figure 8:
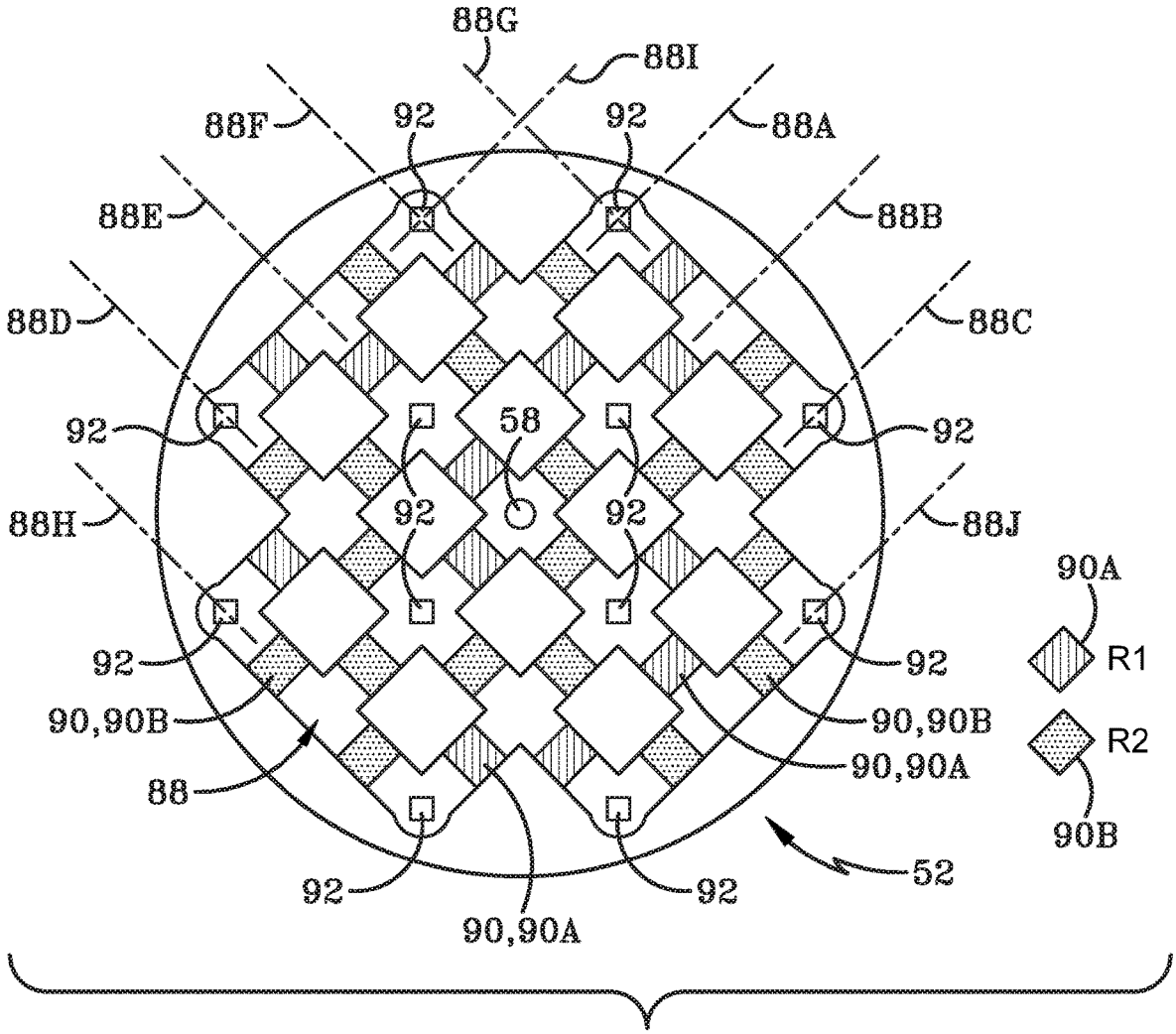
FIG. 8 is a top plan view of a first layer of the top loading card having a plurality of resistors arranged in a lattice configuration to define a resistor network.

FIG. 8 depicts a top view of the first layer 52. The first layer 52 is a resistor network circuit defined by a plurality of resistors that are interconnected via a conductive element 88. The conductive element 88 is arranged in a network. More particularly, the conductive element 88 is arranged in a configuration that provides three rows of sections of the conductive elements that are aligned orthogonal to three other spaced apart rows. Further, in one particular embodiment, the conductive element 88 may be collectively defined by a first row 88A which is spaced apart and parallel to a second row 88B which is spaced apart and parallel to a third row 88C. The three rows 88A-88C are orthogonal to a fourth row 88D which is spaced apart and parallel from a fifth row 88E which is spaced apart and parallel from a sixth row 88F. Additionally, the first three rows 88A-88C may be connected at their first ends via a connecting row 88G and at their second ends via a connecting row 88H. Similarly, the fourth through sixth rows 88D-88F may be connected at their first end via connecting row 88I and connected at their second ends via connecting row 88J. Collectively, the rows 88A-88J form a lattice network along which a plurality of resistors 90 are positioned. In one particular embodiment, the plurality of resistors may include thirty-two resistors. There may be four resistors along the first row 88A, there may be four resistors along the second row 88B, there may be four resistors along the third row 88C, there may be four resistors along the fourth 88D, there may be four resistors along row 88E, and there may be four resistors along row 88F. Additionally, there may be two resistors along row 88G and two resistors along row 88H. There may additionally be two resistors along row 88I and two resistors along row 88J. In some implementations, the resistors 90 may have similar values. However, in other implementations, the resistors 90 may have different values depending upon the optimal performance of the monocone antenna assembly 10. Given the number of combinations of resistor values that are entirely possible (32 factorial combinations), the manner in which the resistive values are chosen may be optimized through computer software that simulates performance data of the monocone assembly 10 to determine which resistors 90 should be positioned along which row of the lattice network defined by the conductive element 88. Through one exemplary simulation, the present disclosure determined that one exemplary optimal resistive network includes a plurality of first resistors (R1) 90A and a plurality of second resistors (R2) 90B.

For example, one particular implementation may provide three first resistors 90A and one second resistor 90B in the first row 88A. There may be two first resistors 90A and two second resistors 90B in the second row 88B. There may be two first resistors 90A and two second resistors 90B in the third row 88C. Even further, the position of the first resistor 90A and the second resistor 90B may alternate with respect to the second row 88B and the third row 88C. For example, if the second row 88B begins with the first resistors 90A, then the third row 88C may begin with the second resistor 90B. Then the resistors alternate between first and second resistors as they extend along the row respectively. The fourth row 88D may include one first resistor 90A and three second resistors 90B. The fifth row 88E may include three first resistors 90A and one second resistor 90B. The sixth row 88F may include two first resistors 90A and two second resistors 90B. Row 88G may include one first resistor 90A and one second resistor 90B. Row 88H may include two second resistors 90B. Row 88I may include one first resistor 90A and one second resistor 90B. Row 88J may include two second resistors 90B. This implementation depicted can include where the first resistors 90A have a resistance of about 2.5 kOhm and the second resistors 90B have a value of about 5 Ohm. It has been empirically determined that these values of resistors arranged in the aforementioned configuration assist in lowering the usable bandwidth spectrum the monocone assembly 10 to a range that was heretofore unachievable given the structure, size, weight, and power constraints of a conventional monocone antenna 12.

Aperture 58 is formed centrally in the first layer 52. More particularly, aperture 58 is formed at the intersection of second row 88B and fifth row 88E. Additionally, there may be vias 92 located at the intersections of some of the rows which are utilized to electrically connect the first layer 52 with the second layer 54. Particularly, there may be a via 92 at the intersection of the first row 88A with row 88G. There may be a via 92 at the intersection of the first row 88A with the fourth row 88E. There may be a via 92 at the intersection of the first row 88A with row 88H. There may be a via 92 at the intersection of the second row 88B with sixth row 88F. There may be a via 92 at the intersection of the second row 88B with the fourth row 88D. There may be a via 92 at the intersection of the third row 88C with row 88G. There may be a via 92 at the intersection of the third row 88C with fifth row 88E. There may be a via 92 at the intersection of the third row 88C with row 88H. Additionally, there may be a via 92 at the intersection of sixth row 88F with row 88I. There may be a via 92 at the intersection of fourth row 88D with row 88I. There may be a via 92 at the intersection of fourth row 88D and row 88J. There may be a via 92 at the intersection of sixth row 88F and row 88J. It is to be further understood that the location of the vias 92 may be alternatively placed at different intersections without departing from the scope of the present disclosure. The vias 92 collectively support the first layer 52 above the second layer 54 but electrically connect the conductive element 88 with portions of the second layer 54.

In one particular embodiment, the conductive element 88 may be formed from etched copper; however, other conductive materials are entirely possible. When assembled, the top pin 58 on the cone 12 extends upwardly into the aperture 58 defined at the intersection of the second row 88B with the fifth row 88E. The upper terminal end 72 of the first pin 64 may lie flush with the conductive element 88. However, it is entirely possible for the terminal free end 72 to extend upwardly beyond the upper surface of the conductive element 88 at the central aperture 106. The conductive element 88 is electrically connected to the pin 64 by connecting, such as by soldering or other known means or manners of electrically connecting the pin 64 to the circular edge of the conductive element 88 that defines the aperture 32. In this manner, the lattice network of resistors on the conductive element 88 are in electrical communication with the cone 12.

Figure 9A:
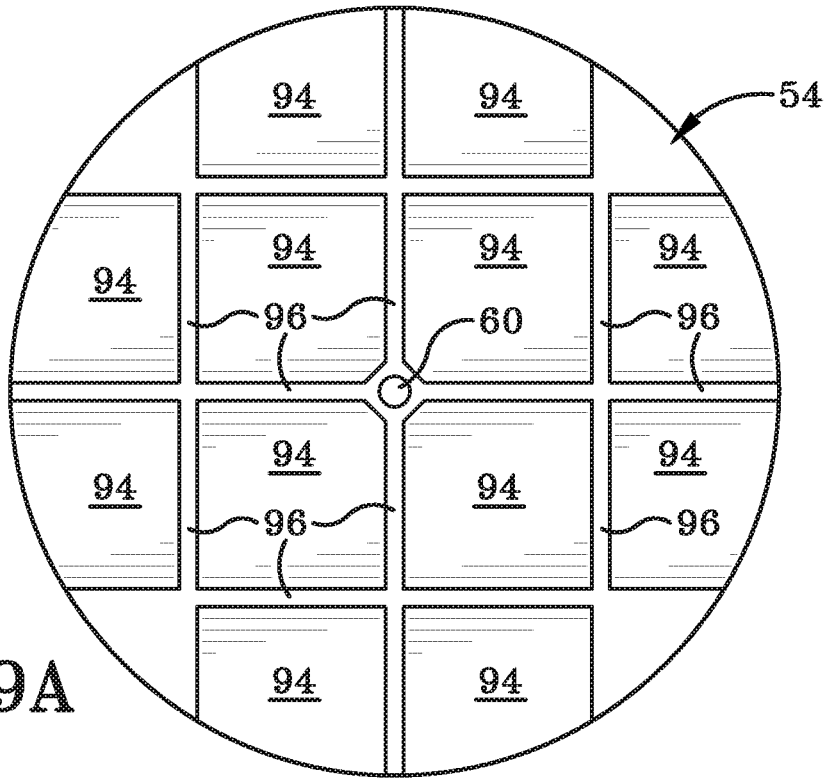
FIG. 9A is a top plan view of a first embodiment of the second layer depicting a plurality of patches that collectively form a patch layer.

FIG. 9A depicts the second layer 54 as a patch layer in accordance with the first embodiment of the present disclosure. The second layer 54 may additionally be referred to as a patch layer inasmuch as it includes a plurality of patches formed from conductive material on a substrate. In accordance with the first embodiment depicted in FIG. 9A, each patch 94 may be formed from an etched copper; however, other conductive materials are entirely possible. In one particular embodiment, each patch formed of conductive material is independent and does not contact adjacent patches. The patches 94 may be generally square shaped. Accordingly, portions 96 of the second layer 54 are positioned between each respective patch such that the patches remain independent and distinct. As will be described in greater detail below, the patches effectively act as a capacitor that work in conjunction with the conductive element 82 in the resistive first layer 54. More particularly, one of the vias 92 is respectively electrically coupled with one of the patches 94. In one particular embodiment, there is only a single via 92 connected to a single patch 94. The portions 96 which separate and segregate each respective patch 94 may be formed from the substrate upon which the patches 94 are carried.

Figure 9B:
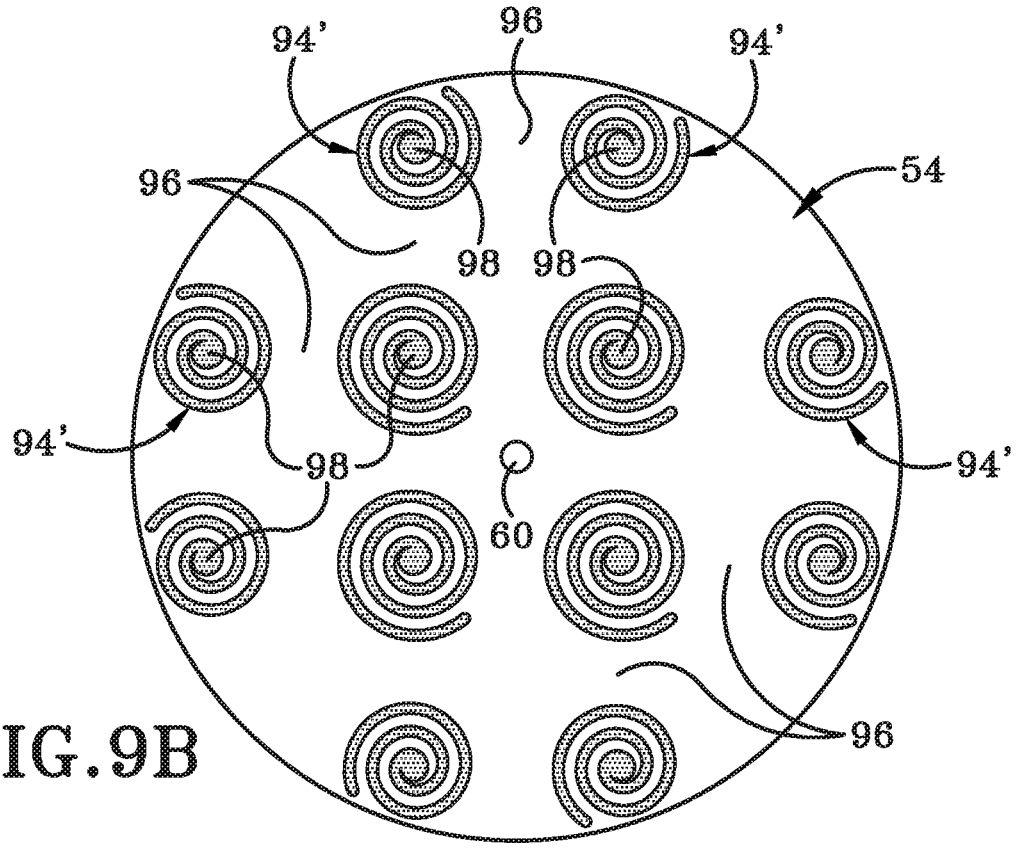
FIG. 9B is a top plan view of a second embodiment of the patch layer wherein each of the respective patches has a spiral configuration.

FIG. 9B depicts an alternative embodiment to the second layer 54. The patches in this embodiment are spiral in shape. The spiral patches 94' are similar in that they are connected at their center 98 to the vias 92 in the first layer 52. Each of the spiral patches 94' is spaced and independent from other adjacent patches and a portion 96 of the second layer 54 separates and segregates each respective spiral patch 94'. It is to be understood that the second layer 54 could have alternative shapes or configurations than what is shown in FIG. 9A and FIG. 9B without departing from the scope of the present disclosure. When using the spiral patches 94' on the second layer 54, only a single via 92 from the first layer 52 connects with a single spiral patch 94' at its center 98. Similar to the patches described in the FIG. 9A, the patches 94' are formed from an etched copper layer or another conductive material. When they are connected with the vias 92 in the first layer 52, they enable second layer 54 to act as a capacitive load on the resistive network first layer 52. Furthermore, while the present disclosure has the first layer 52 being positioned above the second layer 54, it is entirely possible that these layers could be reversed such that the resistive network first layer 52 is positioned below the second layer 54 without departing from the scope of the present disclosure. The second layer 54 each defines a central aperture 60 that receives the pin 64 therethrough so as to center the second layer 54 around the central vertical axis 28. Unlike the first layer 52 which is electrically connected to the pin 64, the aperture 60 receives pin 64 therethrough, but is not electrically connected with the aperture 60. However, patches 94 or 94' are indirectly electronically coupled to pin 64 by way of their electrical connection within element 88 by way of the vias 92.

Figure 10:
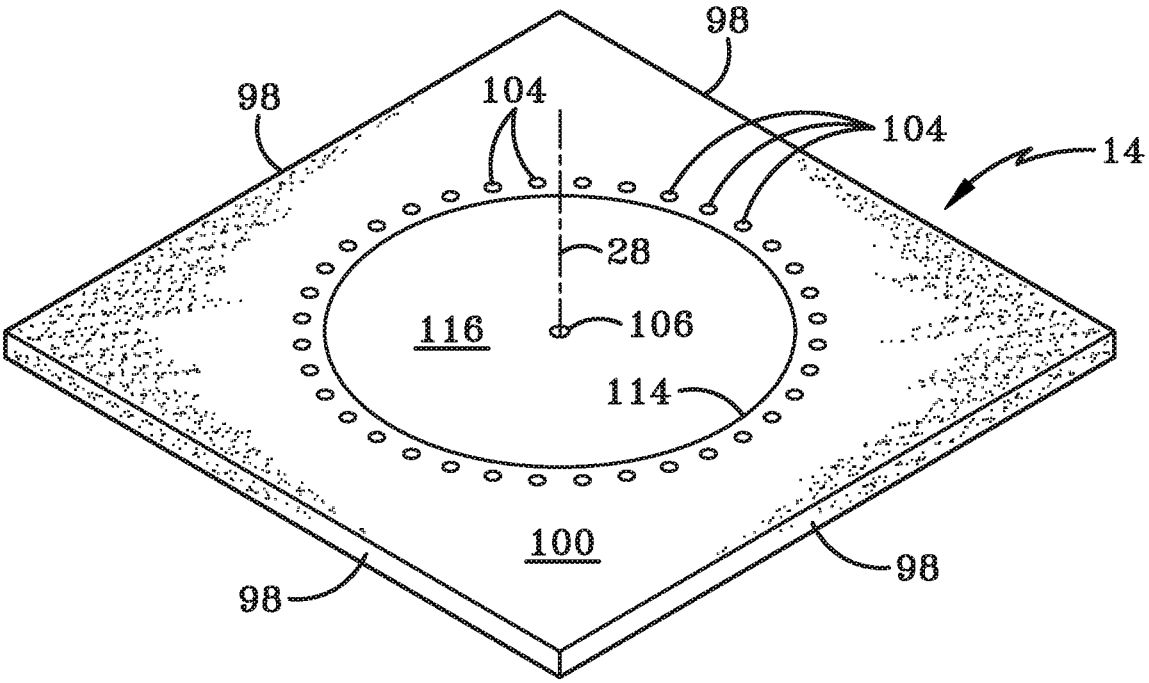
FIG. 10 is a top perspective view of a feed card of the monocone antenna assembly.
Figure 11:
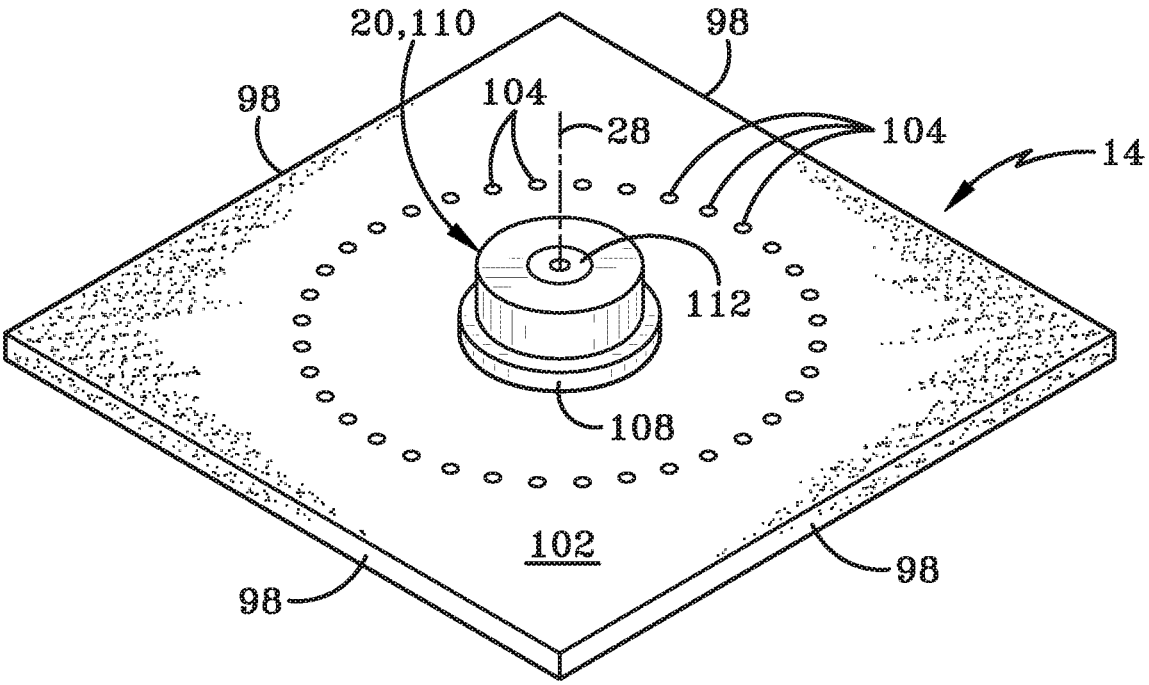
FIG. 11 is a bottom perspective view of the feed card having a connector attached thereto.

FIG. 10 and FIG. 11 depict the loading card or feed card 14 and the connector 20. Feed card 14 may include four sides 98 that are connected together to form a generally square configuration. However, other shapes or other configurations of a feed card 14 are entirely possible without departing from the scope of the present disclosure. Feed card 14 may further include an upwardly facing first surface 100 opposite a downwardly facing second surface 102. Feed card 14 may further include a plurality of plated through holes 104 that are arranged in a circumferential manner extending vertically through the feed card 14. In one particular embodiment, the diameter of the through holes 104 may be about 10 mil. The plated through holes 104 are arranged in a circular configuration relative to the central vertical axis 18 which extends centrally through a central aperture 106 formed in the feed card 14.

The connector 20 may be attached to the second surface 102 of the feed card 14. In one particular embodiment, connector 20 may be a Gilbert push-on type connector (GPO) or a SMP-type connector. Connector 20 may be formed from a conductive material including a flange 108 having a diameter that is greater than a cylindrical portion 110 that extends outwardly along the axis 28 from the flange 108 which is in direct connection with second surface 102. Connector 20 may further include a central cylindrical portion 112 that includes a hollow bore configured to receive and directly connect the cylindrical portion 112 with the lower pin 80 on the monocone 12. Accordingly, the diameter of the inner portion of the cylindrical portion 112 defining the bore should be complement to the diameter on the second pin 80 to effectuate an electrical connection between the connector 20 and the pin 80.

Figure 12:
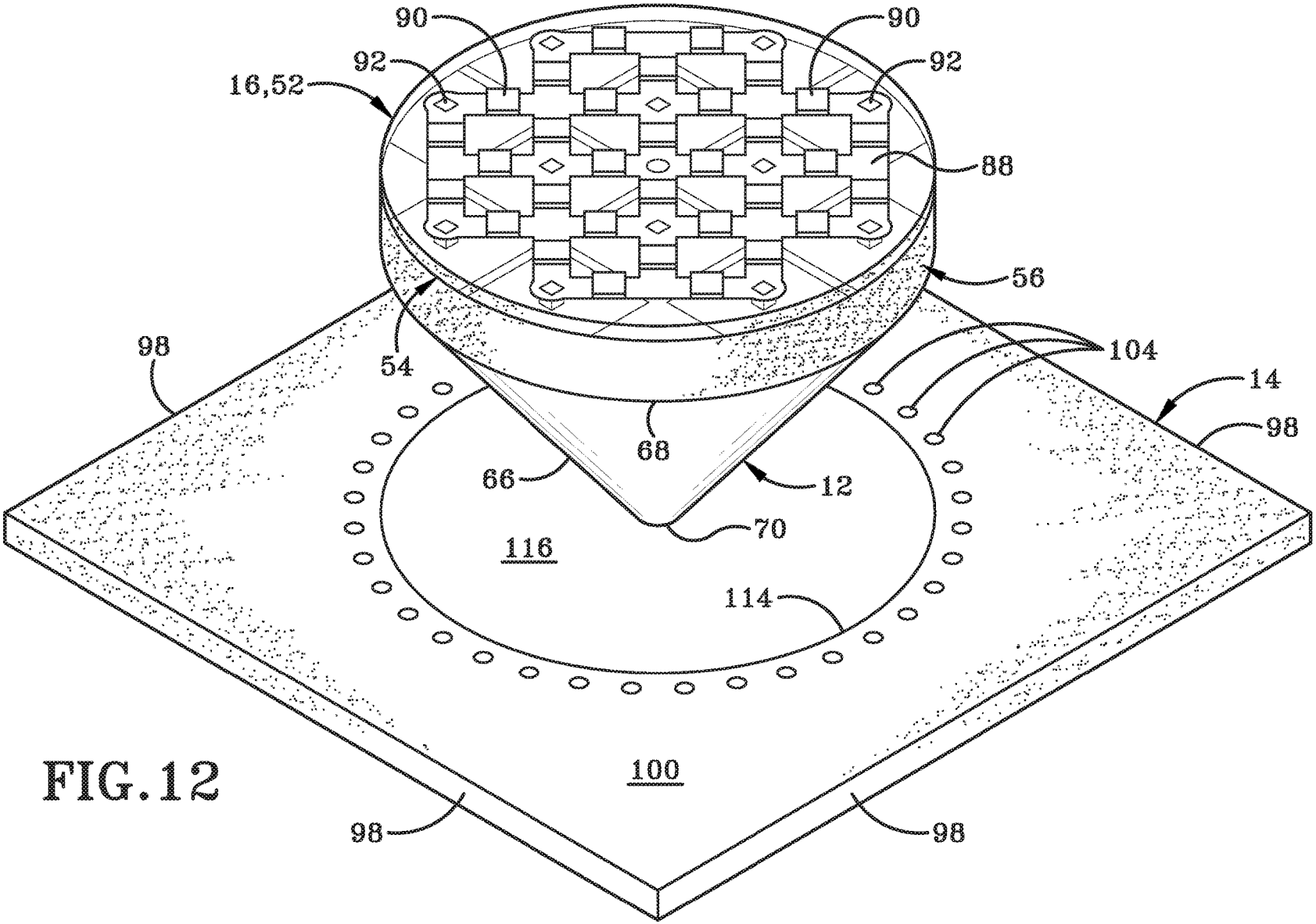
FIG. 12 is a top perspective view of the cone and loading card connected with the feed card.

FIG. 12 is an assembled perspective view of the top loading card 16 formed from the first layer 52, the second layer 54, and the third layer 56 being disposed above the monocone 12 which is connected with the feed card 14. When assembled, the monocone 12 is positioned below the top loading card 16 and generally above the feed card 14 notwithstanding the second pin 80 extending through the central aperture 106 in the feed card 14. The dimensions of the feed card 14 complement those of the cutout 46 formed and defined by the edge 48 in the second surface 38 of the ground plane 18. Thus, if the shape of the feed card 14 were to change, then the shape of the edge 48 that defines the cutout 46 would need to change in a complementary manner. For example, if the feed card 14 had a circular perimeter, then the edge 48 formed in the second surface 38 of the ground plane 18 would be a similar circular shape defining a circular cutout 46. In one particular embodiment, the inner aperture 32 defined by annular edge 44 complements an inner circle 114 on the top loading card 16. Accordingly, when assembled, an inner circular portion 116 faces upwardly through the aperture 32 against the edge 44 in the ground plane 18 aligns and rests atop the inner circle 114 on the feed card 14.

Figure 13:
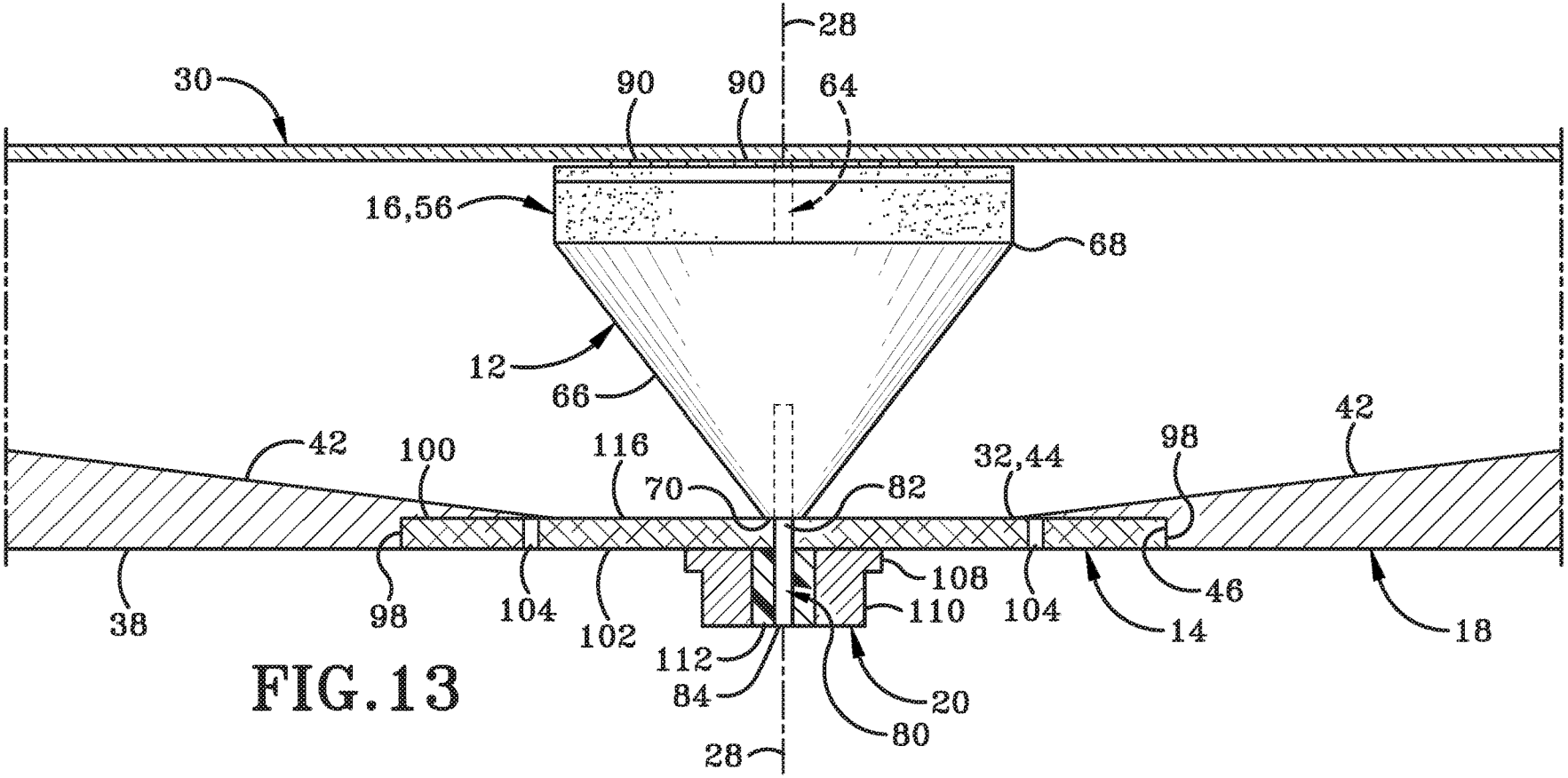
FIG. 13 is a cross-section view of the monocone antenna assembly taken through the center thereof.

FIG. 13 depicts, in cross-section, the center portion of the assembled monocone assembly 10. The radome cover 30 rests atop the ground plane 18 and is supported thereby to protect the monocone 12 and the top loading card 16. Radome cover 30 may contact the top of top card 16. The top loading card 16 may have a diameter extending through the central vertical axis 28 that equals or at least approximates the maximum diameter of the monocone 12 measured at its inverted base or widest portion defined by the upper edge 68. The lower edge 70 of the monocone 12 (i.e., the inverted apex) contacts the feed card 14 which nests within the cutout 46 defined in the second surface 38 of the ground plane 18. The inner portion 42 of the ground plane 18 that tapers inwardly towards the longitudinal axis slightly covers the plated through holes 104 extending through the feed card 14. Inasmuch as the through holes 104 are plated with a conductive material, the conductive material defining the through holes 104 may be in electrical communication with the ground plane 18.

With continued reference to FIG. 13, lower pin 80 may extend centrally along the vertical central axis 28 through the bore of the cylinder 112 in the connector 20. Cylinder 112 is directly connected to pin 80 such that they are in electrical communication with each other. In one particular embodiment, the terminal end 84 of the pin 80 is substantially coplanar with the end of the cylindrical portion 110. Connector 20 is in electrical communication with the pin 80 so as to enable a feed signal to be attached to the connector 20 that may transfer through the feed card 14 into the monocone 12. Inasmuch as the monocone 12 is formed from a conductive material, the signal moving from the feed card 14 may pass upwardly through the conical wall 66 and along the top surface 50 and into the upper first pin 64. The electrical signals moving along the top pin 64 may be in electrical communication and sent through the resistive network first layer 52 that is electrically connected to the first pin 64 via the electrical connection of the conductive element 88 with the pin 64 at the central aperture 58.

Figure 14:
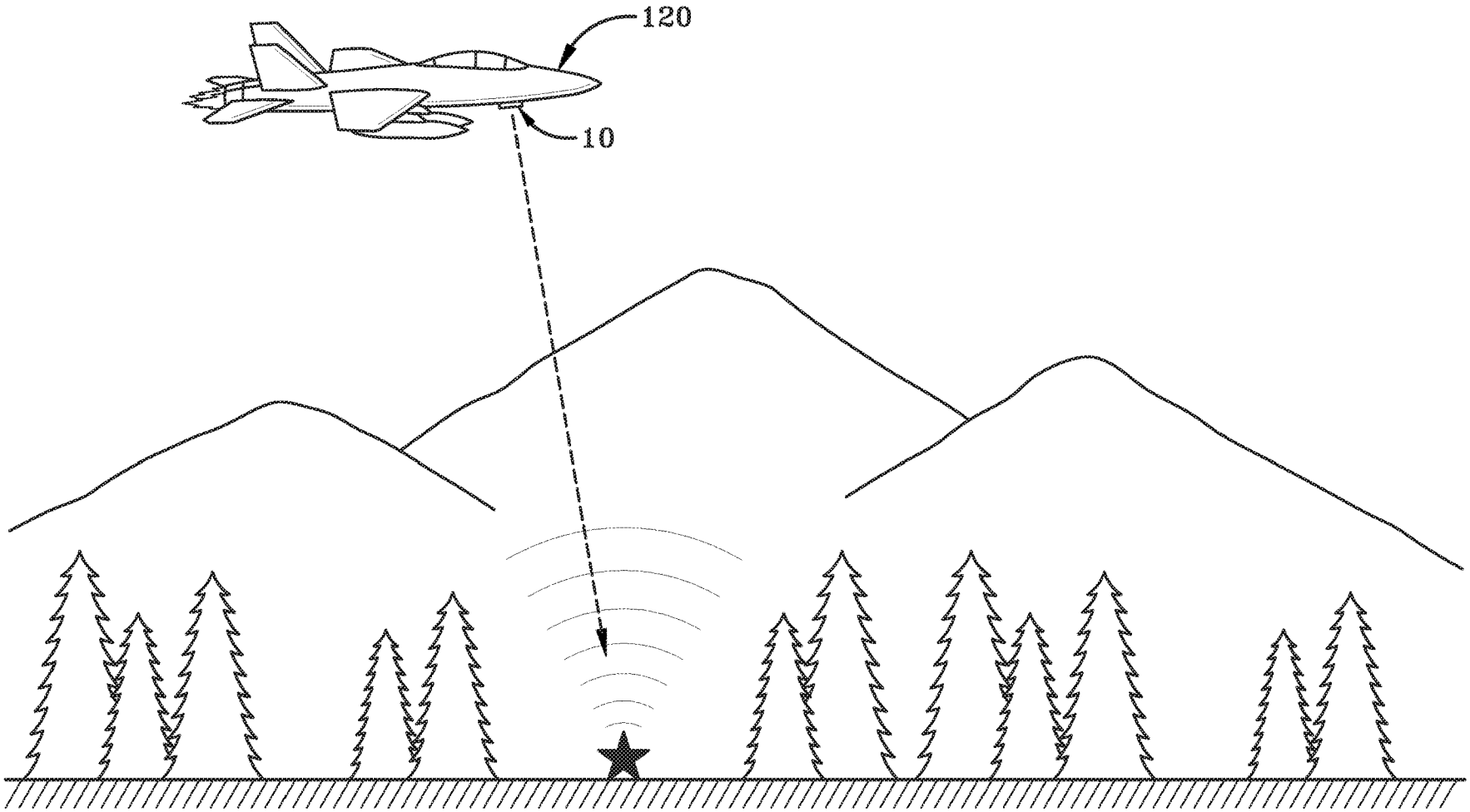
FIG. 14 is a diagrammatic operational view of the monocone antenna assembly mounted on a moveable platform configured to detect a signal emitted from a source.

FIG. 14 depicts an operational diagrammatic view of the monocone antenna assembly 10 being mounted on a moveable platform 120. In one particular embodiment, platform 120 may be any vehicle that is moveable between a first position and a second position. In one particular embodiment, platform 120 is an aerial vehicle, regardless of whether it is manned or unmanned, such as a fixed wing aircraft, a rotorcraft, a UAV, a drone, a satellite, or any other type aerial vehicle. However, it is entirely possible for the platform to be a moveable land-based vehicle, such as a truck, tank, or other vehicle without departing from the scope of the present disclosure. Furthermore, platform 120 may be a sea-based vehicle, such as a ship. In one particular embodiment, the exterior surface of the monocone antenna assembly 10 may be conformal to the outer surface of the platform. For illustrative purposes, FIG. 14 depicts that the monocone antenna assembly 10 as slightly sticking out from the undercarriage of the platform 120 such that antenna assembly 10 can be adequately viewed in FIG. 14. However, when an aircraft is involved, it would be advantageous to have the exterior surface of the monocone antenna assembly 10 be conformal with the outer shell of the platform 120 so as to not interrupt the airstream of the platform. This may improve the aerodynamics of the platform 120 in addition to the benefits of increased bandwidth based on the structural configuration of the monocone antenna 12 as will be described in greater detail below.

Figure 15:
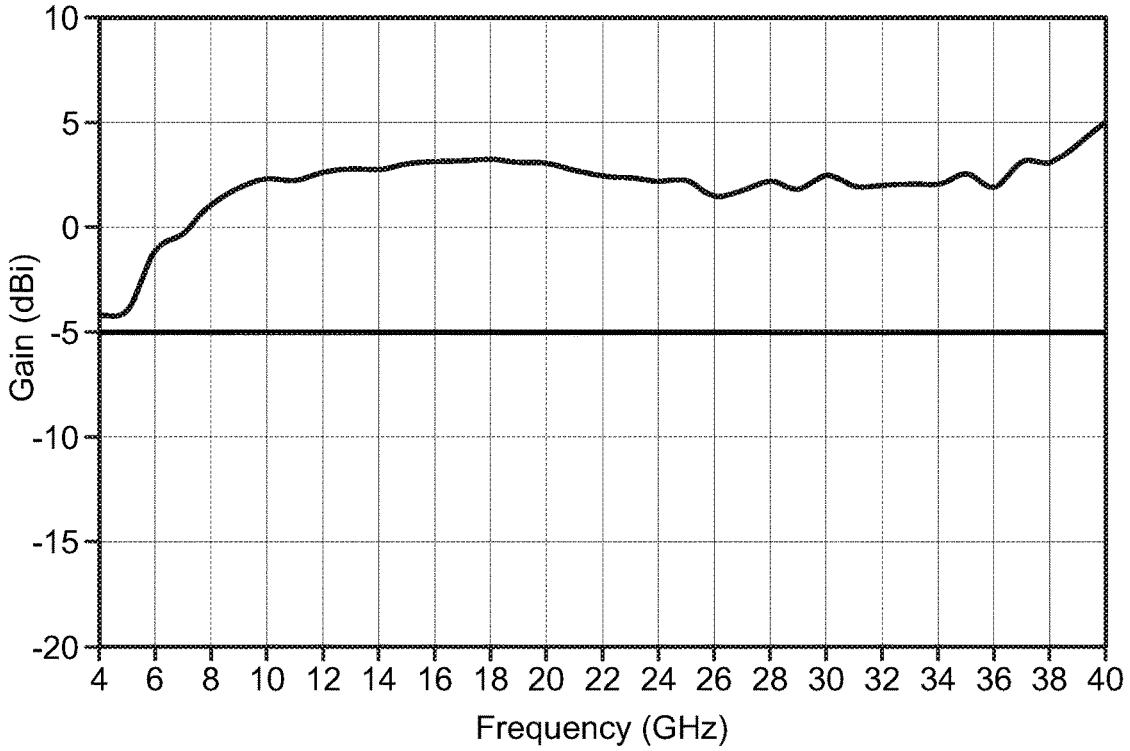
FIG. 15 is a graph depicting the gain of the monocone antenna assembly over a range of frequencies.

FIG. 15 is a graphical representation of a simulated gain achieved by monocone antenna assembly 10 over a variety of frequencies. FIG. 15 depicts that the simulations executed by computer software on the monocone antenna assembly 10 have achieved a gain greater than −5 dBi for frequencies between 4 gigahertz (GHz) and 40 GHz.

Figure 16:
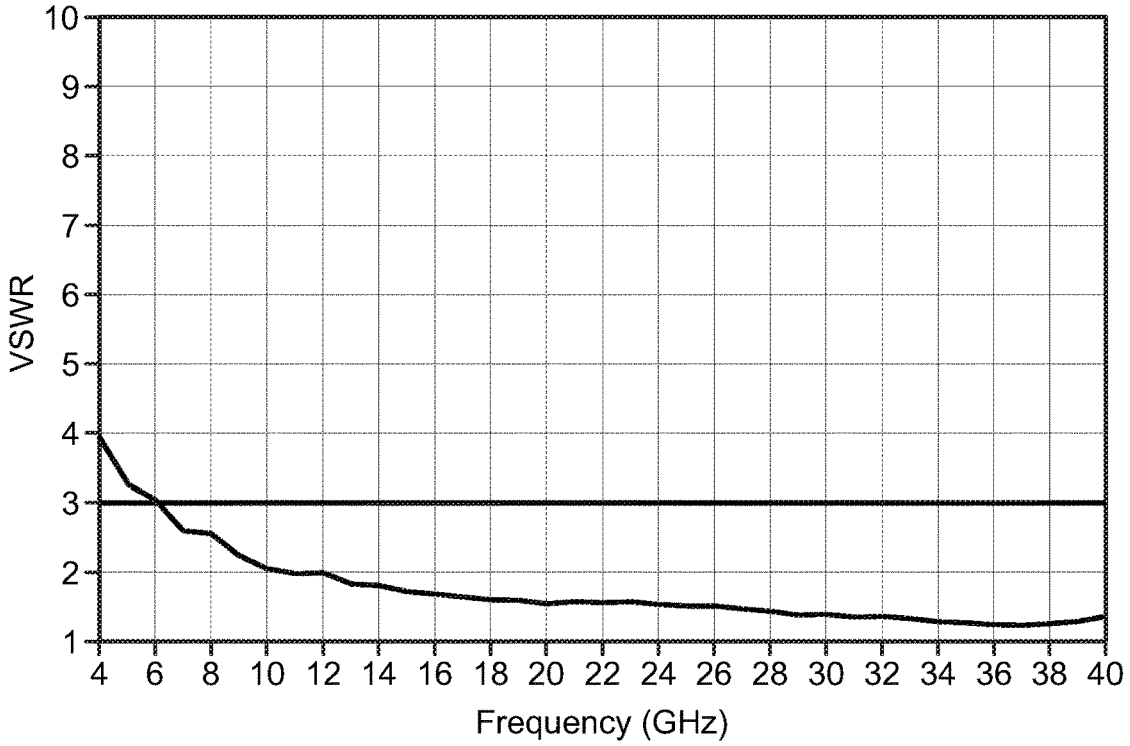
FIG. 16 is a graph of the voltage standing wave ratio over a range of frequencies.
Figure 17:
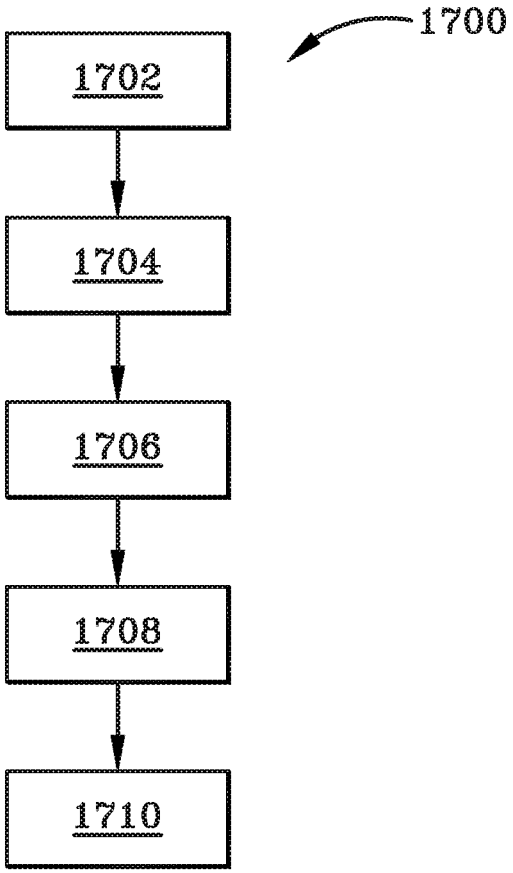
FIG. 17 is a flowchart in accordance with one exemplary method of the present disclosure.

FIG. 16 depicts that the monocone antenna assembly 10 is able to achieve a voltage standing wave ratio (VSWR) less than three for frequencies between 6 GHz and 40 GHz.

In accordance with one aspect of the present disclosure, a monocone antenna could have a lower bandwidth than what has been previously possible by conventional monocone antennas. The present disclosure provides a monocone antenna assembly 10 that is matched to a lower frequency for a smaller size which enables the antenna to be usable at a lower frequency than would typically be physically possible for the identical size constraints.

The patches 94, 94' have a resistance value that may be selectively chosen to represent a desired or optimized pattern. Alternatively, the patches and their respective resistance values may be randomized. The values of the resistors are set for the performance requirements of the antenna. The patches are positioned on the top card 16 to form an intermediate layer that allows them to connect with different resistor values in layer 52. Thus, the patches 94, 94' are resistively connected via a network that sits on top of the cone and acts as a lossy capacitor. The top loading card 16 is attached via the central pin 68 that extends upwardly from the cone. The top pin 68 of the cone 12 attaches to the center point of the top or first layer 52 to electrically connect the cone 12 with the resistor network. At low frequencies, the cone acts as a wire inductor. By adding the "effective capacitance" of the loading card 16 in series with the cone 12, the inductance may be tuned out to get a better or improved match that is lower in frequency.

With respect to the top loading card 16, the top first layer 52 of the resistor network sits above the patch second layer 54. Thus, the loading card is a two-layer circuit card. The substrate or third layer 56, in one particular embodiment, is a 40 millimeter thick Rogers material. However, clearly, other substrate materials are entirely possible. The substrate third layer 56 faces the two-layer circuit card (defined by layer 52 and layer 54) above the top surface of the cone. The top loading card 16 slides centrally along the vertical axis 28 of the top pin 68 such that the pin 68 is electrically connected with the top resistance layer. The pin 68 is not directly electrically conductive with the patch layer or the substrate material. Rather, it is indirectly electrically connected by way of vias 92. However, there may be alternative embodiments or alternative versions of the monocone antenna in which electrically connecting the pin with the substrate or the patch layer may be possible. The lower surface of the substrate is directly abutted and is supported by the upper surface of the cone. The patch layer is formed from etched copper. The patch layer is effectively a capacitor that works in conjunction with the resistor layer connected to the wire on the cone.

The VSWR of the monocone antenna is dependent on the bottom radius of the cone and the space off of a ground plane. Thus, the lower radius of the cone and the dimensional distance of the bottom of the cone from the ground plane are required to match correctly. The circuit loading/feed card 14 may act as a portion of the ground plane for the monocone antenna of the present disclosure. The circuit card ground plane 18 has a tolerance in its thickness of about five percent. Thus, a ground spacer is designed into the circuit board ground plane so that no manual process is required to space the cone from the ground plane. All is required is to put the cone onto the spacer and the construction is complete. A GPO shroud connector 20 receives the lower center pin 80 of the cone 12 such that the inner diameter of the GPO shroud connector 20 complements the outer diameter of the lower electrical pin 80 on the cone. Thus, the lower electrical pin 80 slides within the inner diameter of the GPO shroud connector 20. This enables the cone 12 to be slid into the center of the shroud connector which is connected with the connector on the ground plane. Thus, for manufacturing and fabrication, the cone 12 is easily soldered by joining the lower electrical pin 80 with the GPO shroud connector 20. Thus, the connector 20 is effectively designed as part of the antenna which enables the antenna to have less overall parts and be manufactured less expensively due to the lower part count. Stated otherwise, the connector is conformal to the ground plane.

In one particular embodiment, the cone may be fabricated from an electrically conductive material. For example, the cone may be fabricated from brass or another similar alloy. In another particular embodiment, the cone may be fabricated from a base copper material and may be plated with another material, such as gold. Stated otherwise, the cone may be fabricated from gold-plated copper.

In one particular embodiment, the cone antenna may be recessed in a larger material, such as an aluminum disc. This is beneficial when certain installations, such as military applications, to have all outer surfaces be conformal so that parts are not extending into the airstream of the platform, such as an aircraft, to which the antenna is mounted. The installation may be conformal with the airstream and may include a radome cover 30 covering a portion of the aluminum disc.

In one particular embodiment, the cone 12 may be solid formed from a substantially uniform conducting material. However, in other particular embodiments, the outer sidewalls of the cone may be connected together and define opposing inner and outer surfaces wherein the inner surfaces define an interior containing volume and be empty such that the cone is hollow. In the instance where the cone is hollow, the cone needs to be capped such that it defines an upwardly facing top surface 50 that is connected with the outmost radial edge 68 of the conical sidewall. Stated otherwise, the outer surface of the cone can effectively behave like a shell surrounding an interior volume which may be filled or left empty. The flat plate or the top surface 50 of the cone 12 closes the cone 12 such that to allow currents to flow through the top pin such that currents do not flow back down into the cone. The top surface of the cone further acts to assist and interact with the capacitors on the top card. Thus, a portion of the top plate of the cone assists with the "effective capacitance" of the antenna.

In one particular embodiment, the resistors 90 in the resistive network first layer 52 may be any resistive value and can be optimized to maximize the efficiency of the antenna. In one particular embodiment, every resistor 90 in the resistive layer has one of two values. In one particular embodiment, each resistor may be either five ohms or 2500 ohms. However, other values are entirely possible. Furthermore, which resistors have which resistance value can be optimized to improve efficiency of the antenna. On the monocone 12, at low frequencies, the currents are concentrated towards the top of the cone. As the frequency increases, the currents are closer to the bottom of the cone. Thus, when the top card 16 is placed on top of the cone 12, the top card 16 is effectively transparent at higher frequencies because the electrical fields are not traveling up the conical sides of the cone 12 towards the top card 16 because they are concentrated at the lower half by the feed point near bottom 70. So at low frequencies where the impedance is high on the cones, the cones effectively behave and act as conductors. Thus the VSWR maintains a value less than three because there is little to no radiation resistance (i.e., there is no real part and the imaginary part looks like an inductor). By adding this top pin 68 with a small amount of resistance via resistors 90, then the antenna 10 is able to push a point on the Smith chart towards the center thereof.

Various inventive concepts may be embodied as one or more methods, of which an example has been provided. An exemplary embodiment of the present disclosure may provide a method for a cone antenna 700 comprising: feeding current through a connector coupled to a feed card disposed within a recess formed in a ground plane 1702; feeding current along a frustoconical sidewall from a second end to a first end thereof 1704; feeding current from the frustoconical sidewall across a resistor network 1706; and receiving signals over at least one decade of frequency bandwidth 1708. This exemplary method or another exemplary method may further provide feeding current along a first pin from the frustoconical sidewall to the resistor network that is electrically coupled to the first pin. This exemplary method or another exemplary method may further provide feeding current through at least two resistors in series along the resistor network that are coupled with a plurality of patches that are coupled to the resistor network that effective function as lossy capacitors. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

As used herein, at least one decade of useable bandwidth refers to a unit for measuring frequency ratios on a logarithmic scale, with one decade corresponding to a ratio of 10 between two frequencies (an order of magnitude difference). A closely related unit is the octave, which corresponds to a ratio of 2 between two frequencies.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral" and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A cone antenna assembly comprising:

a cone including a frustoconical sidewall extending from a first end to a second end, the first end having a diameter greater than the second end;

a first pin in electrical communication with the frustoconical sidewall;

at least one resistor in electrical communication with the first pin;

a feed card in electrical communication with the cone adjacent to the second end;

a ground plane including a first surface opposite a second surface; and a recess formed in the second surface shaped complementary to the feed card, and the feed card is disposed within the recess, wherein the cone extends outward from the first surface on the ground plane.

2. The cone antenna assembly of claim 1, wherein the at least one resistor includes a plurality of resistors arranged in a network and in electrical communication with the first pin.

3. The cone antenna assembly of claim 2, wherein the plurality of resistors includes a first row of at least two resistors in series along a conductive element.

4. The cone antenna assembly of claim 3, wherein the plurality of resistors includes a second row of at least two resistors in series along the conductive element that are electrically parallel to the first row.

5. The cone antenna assembly of claim 4, further comprising:

a central aperture formed in the conductive element that receives the first pin therethrough; and an electrical connection between the first pin and the conductive element.

6. The cone antenna assembly of claim 2, further comprising:

a patch layer in electrical communication with the plurality of resistors that effectuates performance as a lossy capacitor.

7. The cone antenna assembly of claim 6, further comprising:

a plurality of independent patches in the patch layer, wherein at least one patch from the plurality of independent patches is electrically connected with the plurality of resistors.

8. The cone antenna assembly of claim 7, wherein at least one of the plurality of independent patches has a spiral configuration.

9. The cone antenna assembly of claim 6, further comprising:

a layer of material surrounding the first pin disposed between the patch layer and the first end of the frustoconical sidewall of the cone.

10. The cone antenna assembly of claim 1, further comprising:

a connector connected with the feed card, wherein a portion of the connector is coplanar with the ground plane.

11. The cone antenna assembly of claim 10, further comprising:

a second pin in electrical communication with the frustoconical sidewall extending outwardly from the second end; and a central bore defined by a portion of the connector, and the second pin positioned within the central bore.

12. The cone antenna assembly of claim 11, further comprising:

a ground spacer on the feed card that eliminates manual manipulation to separate the cone from the ground plane.

13. The cone antenna assembly of claim 12, further comprising:

a cover over the cone to counteract a physical force applied to the connector by a feed when the feed is attached to the connector.

14. A cone antenna assembly comprising:

a cone including a frustoconical sidewall extending from a first end to a second end, the first end having a diameter greater than the second end; and at least one resistor in electrical communication the frustoconical sidewall, wherein the at least one resistor includes a plurality of resistors arranged in a network and in electrical communication with the frustoconical sidewall; wherein the plurality of resistors includes;

a first row of at least two resistors in series along a conductive element;

a second row of at least two resistors in series along the conductive element that are electrically parallel to the first row;

a third row of at least two resistors in series along the conductive element that are electrically parallel to the first row;

a fourth row of at least two resistors in series along the conductive element;

a fifth row of at least two resistors in series along the conductive element that are electrically parallel to the fourth row; and a sixth row of at least two resistors in series along the conductive element that are electrically parallel to the fourth row.

* * * * *